US012630274B2

(12) United States Patent
Khreibani et al.

(10) Patent No.: US 12,630,274 B2
(45) Date of Patent: May 19, 2026

(54) METHODS AND DEVICES TO ASSURE SHIP ENVIRONMENT DISCHARGE COMPLIANCE

(71) Applicants: James Khreibani, Miami Beach, FL (US); Austin Hill, Deland, FL (US)

(72) Inventors: James Khreibani, Miami Beach, FL (US); Austin Hill, Deland, FL (US)

(73) Assignee: James Khrebiani, Miami, FL (US)

( * ) Notice: Subject to any disclaimer, the term of this patent is extended or adjusted under 35 U.S.C. 154(b) by 1201 days.

(21) Appl. No.: 17/535,528

(22) Filed: Nov. 24, 2021

(65) Prior Publication Data

US 2022/0135192 A1 May 5, 2022

Related U.S. Application Data

(60) Provisional application No. 63/118,625, filed on Nov. 25, 2020.

(51) Int. Cl.
*B63B 79/40* (2020.01)
*B63J 4/00* (2006.01)

(52) U.S. Cl.
CPC ..... *B63B 79/40* (2020.01); *B63J 4/004* (2013.01); *B63J 4/006* (2013.01); *B63B 2213/02* (2013.01)

(58) Field of Classification Search
CPC ..... B63B 79/40; B63B 2213/02; B63J 4/00; B63J 4/004; B63J 4/006
USPC ..... 210/739
See application file for complete search history.

(56) References Cited

U.S. PATENT DOCUMENTS

2018/0052246 A1* 2/2018 Hartland ..... G01V 1/3808
2019/0164366 A1* 5/2019 Kirkland ..... G07C 9/00174
2020/0255104 A1* 8/2020 Gonring ..... B63H 21/21

FOREIGN PATENT DOCUMENTS

GB 2550580 A * 11/2017 ..... B63B 17/0036

* cited by examiner

*Primary Examiner* — Akash K Varma

(57) ABSTRACT

This disclosure relates to an environmental compliance system installed onboard a ship. The environmental compliance system includes a computing device that records and requests authorization for overboard discharge when discharge occurs within a defined geofence. The system receives data from the ship automation system including ship location and operational valve opening commands made to discharge effluent overboard and into the surrounding water. Before the operational valve opening command can be received by the valve, the compliance box confirms ship position and compares against programmed no-discharge geofence or a plurality of geofences. When the ship is inside a no-discharge geofence, the computing device may request a manual override authorization from the responsible duty holder before completing the command so as to prevent an accidental unintended discharge. Data is securely stored by the compliance box and may also be transmitted to external cloud-based data receivers.

15 Claims, 2 Drawing Sheets

METHODS AND DEVICES TO ASSURE SHIP ENVIRONMENT DISCHARGE COMPLIANCE

CROSS-REFERENCE TO RELATED APPLICATIONS

This patent application claims the priority date benefit of provisional patent application Ser. No. 63/118625, filed 25 Nov. 2020 by the present inventor, which is incorporated herein in its entirety by reference.

FIELD OF THE INVENTION

Without limiting the scope of the invention, its background is described in connection with methods and devices to assure ship environment compliance, in particular compliance with regulations outlining the process on an overboard discharge of various liquid waste and effluent. In one embodiment, the environmental compliance system may include an independent computing device (also referred to as a compliance console) that records and requests authorization for overboard discharge when the ship is located within a designated no-discharge location, as may be defined by a geofence.

BACKGROUND OF THE INVENTION

MARPOL and specifically Section 312 of the Clean Water Act in the US prohibits untreated sewage discharge within three miles from shore. In order to discharge the sewage within three miles, it must be first treated using a U.S. Coast Guard-approved Type I or Type II Marine Sanitation Device (MSD). Alternatively, sewage or effluent may be stored onboard in a holding tank (Type III MSD). Treated and untreated effluent discharges are prohibited in Freshwater lakes, reservoirs, and other freshwater impoundments when inlets or outlets are such as to prevent the ingress or egress by vessel traffic. Discharge is also prohibited in rivers not capable of navigation by interstate vessel traffic and in designated no-discharge zones (NDZs). In these areas, sewage effluent generally must be retained on board in a holding tank (Type III MSD). Operators of vessels equipped with flow-through MSDs (Type I or Type II) must secure the device to prevent overboard discharge.

On Oct. 26, 2020, EPA's Notice of Proposed Rulemaking—Vessel Incidental Discharge National Standards of Performance—was published in the Federal Register for public comment. The proposed rule would reduce the environmental impact of discharges, such as ballast water, that are incidental to the normal operation of commercial vessels. The Vessel Incidental Discharge Act (VIDA) intends to streamline the patchwork of federal, state, and local requirements for the commercial vessel community. The VIDA applies to:

a. Commercial vessels greater than 79 feet in length;
b. Other non-recreational, non-Armed Forces vessels, such as research and emergency rescue vessels; and
c. Ballast water only from small vessels (vessels less than 79 feet in length) and fishing vessels of all sizes.

Two years after EPA publication of the final Vessel Incidental Discharge National Standards of Performance, the U.S. Coast Guard (USCG) is required to develop corresponding implementation, compliance, and enforcement regulations for those standards, including any requirements governing the design, construction, testing, approval, installation, and use of devices necessary to achieve the EPA standards.

For the purposes of this disclosure, the term "effluent" discharge is defined as any overboard discharge of a liquid, optionally mixed with solid or gas inclusions from inside the ship hull to the surrounding body of water outboard of the ship hull. Effluent may include the following non-limiting examples: ballast water, sewage, black water, gray water, anchor chain drain water, engine cooling water, turbine cooling water, desalination brine discharge, sonar dome discharge, deck runoff, bilge discharge, inert gas system, etc.

The VIDA also called for EPA's Great Lakes National Program Office (GLNPO) to establish, in collaboration with other federal agencies, a Great Lakes and Lake Champlain Invasive Species Program (GLLCISP) lead by the University of Wisconsin. The project involves research, development, and piloting of ballast water management systems for use by commercial vessels operating solely within the Great Lakes and Lake Champlain Systems. Despite the regulations around the globe, numerous breaches continue to occur due to the absence of active hardware to prevent uncontrolled releases from occurring.

It is well known in the art that computers can control the opening and closing of operational valves based on external commands from sensors and human-machine interfaces. In one example, U.S. Pat. No. 3,878,376 disclosed a computer receiving commands from transducers through an analog to a digital converter to control valves. However, this disclosure does not have the ability to modify its behavior based on geographical position and geofence. In another example, U.S. Pat. No. 3,789,409 disclosed a method of navigation using at least two earth satellites, the instantaneous locations of which are precisely known to determine a ship's precise location. However Eastern did not disclose a solution to control ship machinery based on a geofence.

In another known example of the prior art, U.S. Pat. No. 4,837,700 disclosed a method of using a road vehicle's GPS coordinates and placing the precise location on a digital map. This device, however, does not solve the issues resolved by the present invention. Furthermore, U.S. Pat. No. 8,018,329 disclosed that once a geo-fence is defined and established, it can be activated to notify the owner of an asset and/or some other entity of movement of the asset beyond the boundary specified by the geo-fence. However, it fails to address the issue specifically related to ship machinery control and preventing a ship or an ocean transportation vessel from accidently discharging an effluent overboard in a no-discharge zone.

The need exists therefore for a novel and durable technical solution addressing the need to control an overboard discharge of one or more effluents and prevent an accidental discharge within the boundaries of a no-discharge zone.

The need also exists for a method and device to record the movements of the ship vs the record of discharge of effluent so as to enable technical documentation confirming compliance of the ship discharge action against applicable regulatory constraints.

SUMMARY

This disclosure relates to an environmental compliance system installed onboard a ship or other water transportation vessel. The environmental compliance system includes a computer or compliance console made from generic computer hardware that records and requests authorization for overboard discharge when discharge is inside a designated no-discharge location defined by a geofence. The system receives data from the ship automation system which may include ship location and valve opening commands made to discharge effluent overboard and into the surrounding water. Before the valve opening command can be received by the valve the compliance box confirms ship position and compares it against the ship's real-time location for example and without limitation using similar technology as a vehicle satellite navigation system or another location-based service well known in the art. When the ship is in a location defined as a no-discharge zone the compliance box will request authorization from the responsible duty holder before completing the command, therefore, preventing an accidental overboard discharge within a no-discharge zone. Additionally, the system may log the subsystem process name, discharge location, and duration when a command is given to discharge within an area defined as a no-discharge area by a geofence. The data may be securely stored by the compliance box and may also be transmitted to external data storage as non-transitory computer-readable medium.

The method for preventing accidental overboard discharge of a first effluent from a ship within a first no-overboard discharge zone designated for the first effluent may include the following steps:

a. continuously operating a computing device to compare ship coordinates with a predetermined geofence defining a boundary of the first no-overboard discharge zone;
b. if the ship coordinates are determined to be outside the first no-overboard discharge zone, operating the computing device to automatically allow initiating or continuation of an overboard discharge of the first effluent by opening a first operational valve controlling the discharge, the first operational valve is operatively connected to the computing device,
c. if the ship coordinates are determined to be within the first no-overboard discharge zone, operating the computing device to automatically prevent or stop the overboard discharge of the first effluent by closing the first operational valve, and
d. operating the computing device to provide for a manual override option for the automated operation of either step (b) or step (c).

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE INVENTION

Figure 1:
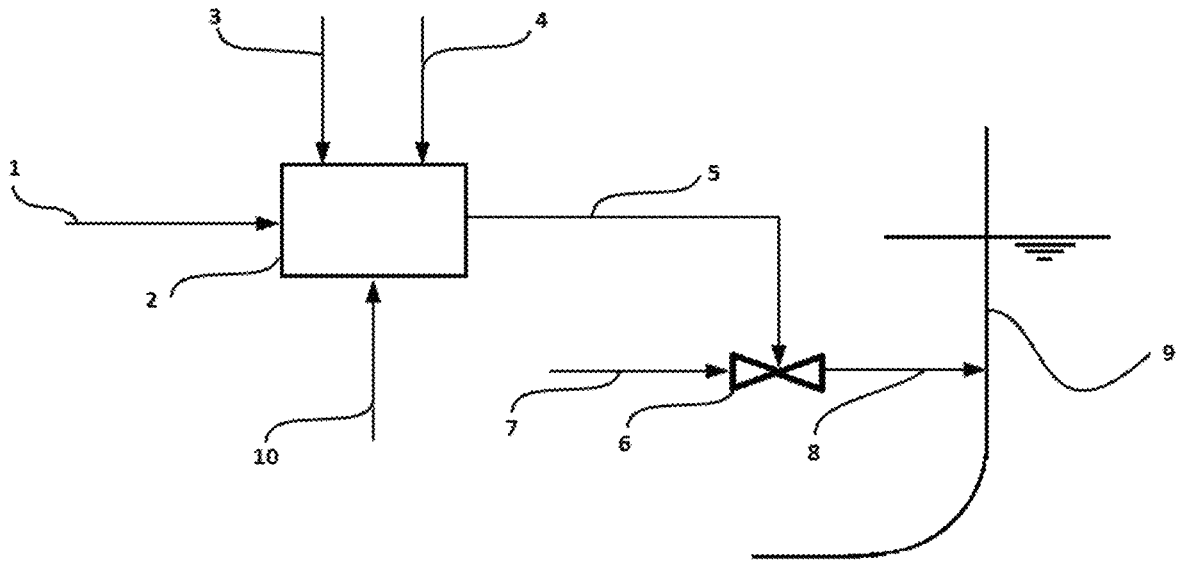
FIG. 1 shows a flow diagram and schematic of the system according to the invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIG. 1 shows a flow diagram and section of the ship hull schematically illustrating the use of the disclosure with the steps required to complete overboard discharge. The reference numerals represent the following:

1 Operational discharge command
2 The computing device or Compliance console
3 Predetermined no-discharge geofence coordinates
4 Ship navigation coordinate system
5 Compliance console command
6 One or more overboard operational valve unit
7 One or more isolated discharge effluent
8 One or more discharge effluent
9 Ship hull
10 Duty holder override command By way of a non-limiting example, and referring to FIG. 1, one exemplary embodiment of the disclosure comprises an operational discharge command (1) coming from either the vessel control system (not shown in the drawings) or a local control panel (also not shown) and sent to the compliance console (2), also referred to as a computing device in this description. The computing device may be integrated into the computer control system of the ship, in which case the entire method of the invention may be practiced as additional software to the existing onboard computer system. In the alternative, it may be a stand-alone computer operatively connected to respective operational valves configured to control an overboard discharge of one or more effluents. Communications and commands to and from the computing device (2) may be transmitted either via suitable cables or wirelessly as the invention is not limited in this regard. In embodiments, a variety of wireless communication protocols may be used for this purpose, such as for example Bluetooth, another wireless computer network, as well as any suitable satellite or radio communication and signaling.

The computing device of the compliance console (2) may be a generic commercially available (COTS) computer hardware programmed to receive and record the coordinates of one or more no-discharge geofence (3) using standard computer programming methods well known in the art. The enclosure containing the computing device may be sealed and available for inspection under secure conditions so as to prevent tampering therewith. The computing device may also be configured to provide a backup of its records, such backup may be transmitted to an external location, such as cloud-based storage or another external server as the invention is not limited in this regard. Storing records of the computing device externally may also advantageously facilitate inspection and auditing of the ship records to assure environmental compliance.

The predetermined no-discharge geofence (3) record is defined as a set of geographical coordinates that outlines the boundary of a specific one or more no-overboard discharge zones, such as a first no-overboard discharge zone, a second no-overboard discharge zone, etc. A no-discharge zone may be any body of water where the overboard discharge of effluent from the vessel may be limited, controlled, or prohibited altogether. Each no-overboard discharge zone may correspond to a specific effluent, such as a first effluent, a second effluent, a third effluent, etc. In some embodiments, these no-discharge zones may overlap or coincide with each other for two or more effluents, while in other embodiments they may denote different areas altogether as the invention is not limited in this regard. A single computing device (2) may be configured to handle overboard discharge regulations for more than one effluent independently, which is yet another advantage of the present invention.

Figure 3:
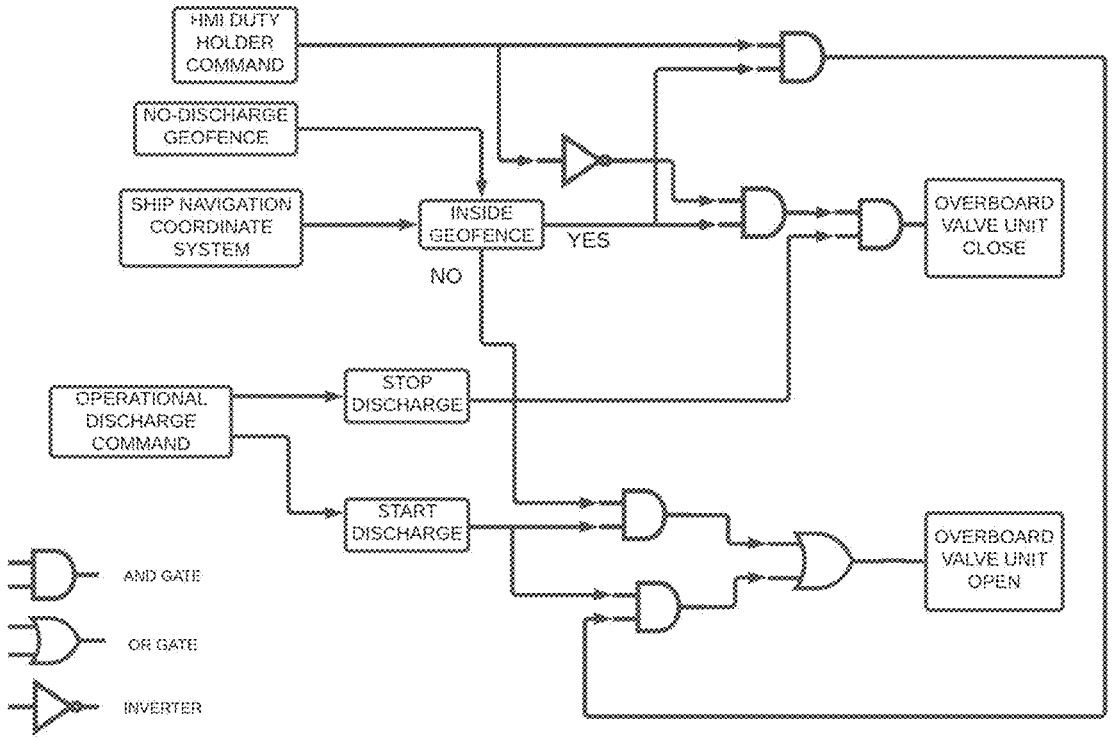
FIG. 3 shows a logic diagram for the system shown in FIG. 1.

Operational logic is illustrated in FIG. 3. When the compliance console (2) receives an operational discharge command (1), the ship location coordinates from a ship navigation coordinate system (4) are compared to the coordinates of the no-discharge geofence (3). The ship navigation coordinate system (4) may use GPS or other global coordinate system which can be integral with or provided separately to the compliance console (2). When the operational discharge command (1) is given with the ship located outside of the no-discharge geofence (3), the compliance console (2) issues a compliance console command (5) to cause an operational overboard valve unit (6) to open. An operational overboard valve unit (6) may comprise a valve, a command receiver (not shown), and at least one of a mechanical and an electrically-activated valve actuator (not shown), which are well known in the art. In embodiments, one or more operational valves (6) may be used to independently control overboard discharge of respective one or more effluents. When the operational valve unit (6) receives the OPEN command from the compliance console (2), the actuator opens the valve (not shown) and the corresponding isolated discharge effluent (7) passes through the overboard valve unit (6) to form a discharge effluent (8) to be ejected overboard through the ship hull (9).

Should the compliance console (2) receive an operational discharge command (1) while the ship is inside the no-discharge geofence (3), the compliance console (2) may request the duty holder or responsible member of the ship crew to override the compliance console (2) by manually entering a duty holder override command (10). The duty holder override command (10) may include a method to authenticate the person activating an override, such as for example a personalized keypad code, a physical key, a key fob, a fingerprint scan, a retina scan, or another method to secure a human to machine interface. When the compliance console (2) receives an accepted duty holder override command (10), then the compliance console (2) issues a compliance console command (5) to the operational overboard valve unit (6), and the subsequent steps previously described are repeated.

In certain situations, a compliance console command (5) may be issued while the vessel is outside the no-discharge geofence (3) but is expected to enter into a geographical position that is inside a no-discharge geofence (3) while effluent discharge is still proceeding. In this case, a compliance console (2) may be configured to compare changing data from the ship navigation coordinate system (4) to the no-discharge geofence (3) and programmed to send a compliance console command (5) to the overboard operational valve unit (6) to close. To resume discharging effluent (8), a duty holder override command (10) may be required, and the subsequent steps previously described may be repeated once the override is complete.

Figure 2:
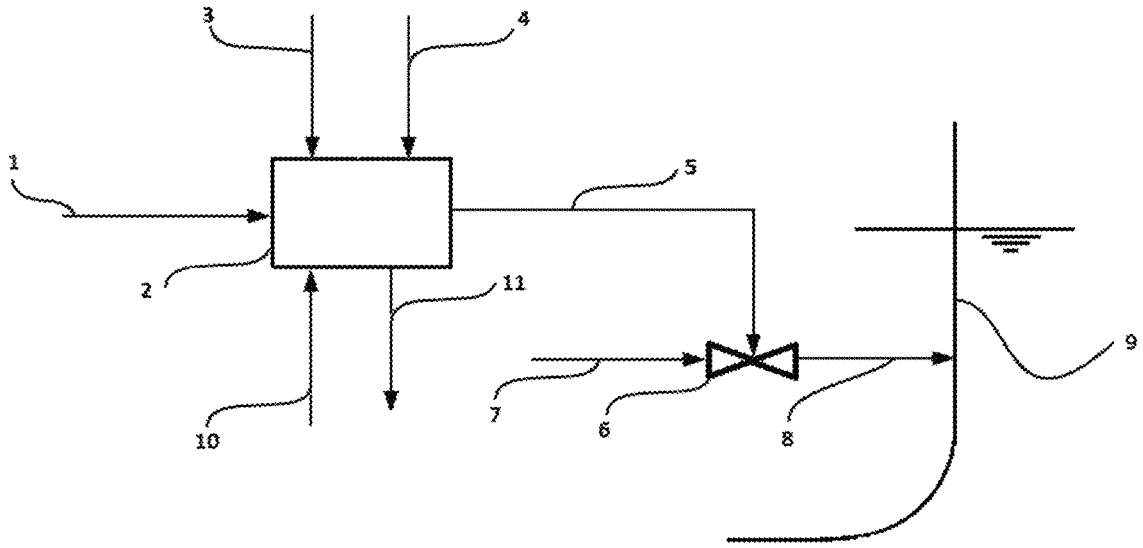
FIG. 2 shows an alternative flow diagram and schematic of the system.
Figure 4:
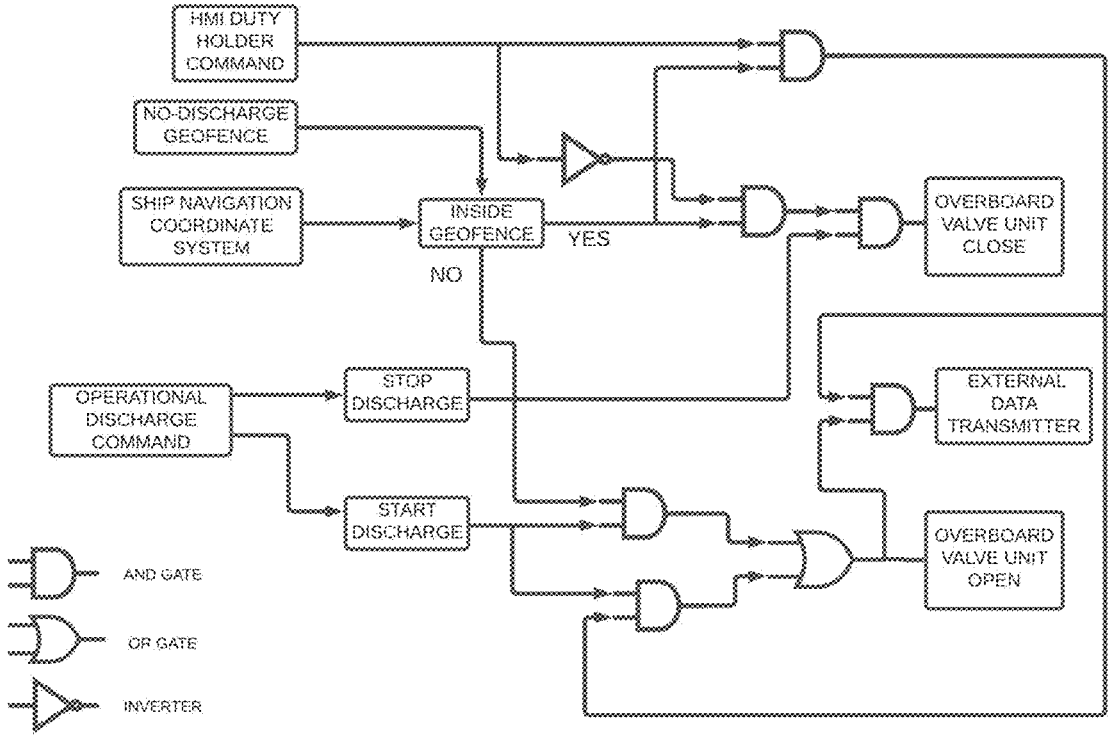
FIG. 4 shows a logic diagram for the system shown in FIG. 2.

FIG. 2 shows an alternative flow diagram of the present invention, with FIG. 4 showing a corresponding logic diagram. The reference numerals are the same as in FIG. 1 with the addition of an external data transmitter (11). In this embodiment of the disclosure, a compliance console (2) may transfer data to an external data transmitter (11) that then transmits data to at least one or more of an external data storage device (not shown) including that of cloud-based servers (not shown) as a non-transitory computer-readable medium.

The advantage of the various embodiments of the invention is the prevention of human error and negligence that can lead to gross breaches of overboard discharge and pollution limits in designated geographical locations.

Based on a description above, the general method for preventing an accidental overboard discharge of a first effluent from a ship within a first no-overboard discharge zone designated for the first effluent may comprise the steps of:

a. continuously operating a computing device (2) to compare ship coordinates (such as received from a ship coordinate system (4)) with a predetermined geofence (3) defining a boundary of the first no-overboard discharge zone;

b. if the ship coordinates are determined to be outside the first no-overboard discharge zone, operating the computing device (2) to automatically allow initiating or continuation of an overboard discharge of the first effluent (8) by opening a first operational valve (6) controlling the discharge, the first operational valve (6) is operatively connected to the computing device (2), c. if the ship coordinates are determined to be within the first no-overboard discharge zone, operating the computing device (2) to automatically prevent or stop the overboard discharge of the first effluent by closing the first operational valve (6), and d. operating the computing device (2) to provide for a manual override option (10) for the automated operation of either step (b) or step (c).

The method of the invention may also include the computing device (2) further operated to prevent an accidental overboard discharge of a second effluent within a second no-overboard discharge zone designated for the second effluent.

The method may further include steps to operate the computing device (2) to receive ship coordinates, and wherein the steps to prevent the accidental overboard discharge of the second effluent within the second no-overboard discharge zone further comprising the following steps:

e. continuously operating the computing device (2) to compare ship coordinates with a predetermined geofence defining a boundary of the second no-overboard discharge zone (3);

f. if the ship coordinates are determined to be outside the second no-overboard discharge zone (3), operating the computing device (2) to automatically allow initiating or continuation of an overboard discharge of the second effluent by opening a second operational valve (6) controlling said discharge, said second operational valve (6) is operatively connected to the computing device (2), g. if the ship coordinates are determined to be within the second no-overboard discharge zone (3), operating the computing device (2) to automatically prevent or stop the overboard discharge of the second effluent by closing the second operational valve (6), and h. operating the computing device (2) to provide for a manual override option for the automated operation of either step (f) or step (g).

The method may include steps to operate the computing device (2) to prevent an accidental overboard discharge of further effluents within further no-overboard discharge zones designated to correspond to the further effluents. To achieve this objective, the computing device (2) may be operatively connected to and control the operation of further operational valves, each of the further operational valves is configured to control an overboard discharge of a corresponding further effluent, whereby the computing device (2) is configured to individually control the discharge of further effluents and prevent an accidental overboard discharge thereof within the boundaries of a no-overboard discharge zone corresponding thereto.

The method may further include a step of recording of ship coordinates corresponding to opening and closing of the first operational valve, thereby creating a record of overboard discharge and no-discharge of the first effluent corresponding to ship position relative to the first no-overboard discharge zone. The step of recording may include a step of recording of ship coordinates, recoding of time when the first operational valve is open, and recording of ship coordinates and time when the first operational valve is closed. The step of recording may be conducted using a non-transitory computer readable medium, such as an external data storage device or a cloud-based computer storage medium.

The method of the invention may further include the computing device further configured to automatically close the first operational valve upon detecting the ship crossing into the first no-overboard discharge zone, whereby preventing the first effluent from discharging overboard within the first no-overboard discharge zone.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims. The environmental compliance system includes a computer or compliance console (2) made from generic computer hardware that records and requests authorization for overboard discharge when discharge is outside a designated discharge location defined by a geofence (3). The compliance console (2) receives data including location from the Ship navigation coordinate system (4) and valve Operational discharge commands (1) made to discharge effluent overboard and into the surrounding water. Before the Operational discharge commands (1) can be received by the overboard valve unit (6) the compliance console (3) confirms ship position and compares it against the allowable discharge zone defined by a geofence (3). When the ship is outside a location defined as a discharge zone the compliance console (3) will request authorization from a Duty holder override command (10) before completing the command to open the overboard operational valve unit (6), therefore, preventing an accidental overboard discharge outside a discharge zone. When the ship is inside a location defined as a discharge zone the compliance console (2) allows the overboard operational valve (6) unit to operate without further instruction. The prior and subsequent steps and procedures described in previous embodiments may be followed and consider to be within the scope of the claims.

We claim:

1. A method for preventing an overboard discharge of a first effluent from a ship within a first no-overboard discharge zone designated for the first effluent, the method comprising the following steps:

a. loading a geofence database comprising at least one predetermined geofence coordinate set defining boundaries of the first no-overboard discharge zone onto a computing device, wherein the computing device is connected to a vessel automation system,
wherein the computing device is operatively coupled to a ship navigation coordinate system providing real-time vessel coordinate or positioning data to the computing device;

b. continuously operating the computing device to process operational discharge instructions by comparing vessel coordinates against geofence boundaries in real-time;

c. operating the computing device to intercept operational discharge instructions from the vessel automation system, d. if the ship position is within the first no-overboard discharge zone, precluding passing on of a discharge command for execution;

e. if the ship position is outside the first no-overboard discharge zone, allowing passing on of the discharge command for execution;

f. operating a Human Machine Interface to provide for a manual override option for the automated operation of steps (b) through (e), wherein the Human Machine Interface is configured to automatically request an authenticated override authorization when operational override instructions are attempted within first no-overboard discharge zone.

2. The method for preventing an overboard discharge, as in claim 1, wherein in step (f), the authenticated override comprises at least one of: a pin number, a fingerprint scan, a retina scan, a facial scan, a physical security key, or a key fob.

3. The method for preventing an overboard discharge, as in claim 1, wherein in step (c) the computing device is operatively connected to a supplemental coordinate system, which is separate from the ship navigation coordinate system for providing real-time vessel coordinate or positioning data.

4. The method for preventing an overboard discharge, as in claim 1, wherein the computing device is further operated to prevent an overboard discharge of the first effluent within a second no-overboard discharge zone designated for a second effluent.

5. The method for preventing an overboard discharge, as in claim 4, wherein the computing device is further operated to prevent an overboard discharge of the second effluent within the second no-overboard discharge zone.

6. The method for preventing an overboard discharge, as in claim 5, wherein the steps to prevent the overboard discharge of the second effluent within the second no-overboard discharge zone further comprising the following steps:

h. loading a geofence database comprising at least one predetermined geofence coordinate set defining boundaries of the second no-overboard discharge zone onto a computing device, i. continuously operating the computing device to compare vessel coordinates against the second no-overboard discharge zone in real-time;

j. operating the computing device to intercept operational discharge instructions from the vessel automation system, k. if the ship position is within the second no-overboard discharge zone, precluding passing on of a discharge command pertaining to the second effluent;

l. if the ship position is outside the second no-overboard discharge zone, allowing passing on of the discharge command pertaining to the second effluent.

7. The method for preventing an overboard discharge, as in claim 6, wherein the computing device is further operated to prevent an overboard discharge of further effluents within further no-overboard discharge zones designated to correspond to the further effluents.

8. The method for preventing an overboard discharge, as in claim 7, wherein the computing device is operatively connected to the vessel automation system and configured to intercept overboard discharge commands pertaining to further effluents, whereby the computing device is configured to individually preclude or allow passing on of the corresponding discharge commands pertaining to further effluents.

9. The method for preventing an overboard discharge, as in claim 1, further comprising a step of recording ship coordinates corresponding to the issuance of the discharge command, thereby creating a record of overboard discharge and no-discharge action pertaining to the first effluent and corresponding to the ship position relative to the first no-overboard discharge zone.

10. The method for preventing an overboard discharge, as in claim 9, wherein the step of recording further includes a step of recording the ship coordinates and time when the discharge command for the first effluent is issued, and recording a duration of first effluent discharge.

11. The method for preventing an overboard discharge, as in claim 9, wherein the step of recording is conducted using a non-transitory computer-readable medium.

12. The method for preventing an overboard discharge, as in claim 9, wherein the step of recording further comprising a step of recording using an external data storage device.

13. The method for preventing an overboard discharge, as in claim 12, wherein the external data storage device is a cloud-based computer storage medium.

14. The method for preventing an overboard discharge, as in claim 1, wherein the computing device is further configured to terminate discharge command upon detecting the ship crossing into the first no-overboard discharge zone, thereby preventing the first effluent from being discharged within the first no-overboard discharge zone.

15. The method for preventing an overboard discharge, as in claim 1, wherein the computing device is further configured to preclude further discharge upon detecting the ship crossing into the first no-overboard discharge zone, thereby preventing the first effluent from discharging overboard within the first no-overboard discharge zone.

* * * * *